US005369419A

United States Patent [19]

Stephenson et al.

[11] Patent Number: 5,369,419

[45] Date of Patent: Nov. 29, 1994

[54] METHOD AND APPARATUS FOR MARKING A RECEIVER MEDIA WITH SPECULARLY DIFFERENTIATED INDICIA

[75] Inventors: Stanley W. Stephenson, Spencerport; David Jeanmaire, Brockport, both of N.Y.

[73] Assignee: Eastman Kodak Company, Rochester, N.Y.

[21] Appl. No.: 903,388

[22] Filed: Jun. 24, 1992

[51] Int. Cl.[5] ..... B41J 2/32

[52] U.S. Cl. ..... 347/61; 346/76 PH; 346/135.1

[58] Field of Search ..... 346/76 PH, 135.1, 1.1; 400/120

[56] References Cited

U.S. PATENT DOCUMENTS

| | | | |
|---|---|---|---|
| 4,516,137 | 5/1985 | Yasui | 346/76 PH |
| 4,553,833 | 11/1985 | Kanaoka et al. | 355/40 |
| 4,710,781 | 12/1987 | Stephenson | 346/76 PH |
| 4,710,783 | 12/1987 | Caine et al. | 346/76 PH |
| 4,778,782 | 10/1988 | Ito et al. | 503/227 |
| 4,983,991 | 1/1991 | Palonen | 346/33 ME |
| 4,995,741 | 2/1991 | Mecke et al. | 400/120 |
| 5,064,301 | 11/1991 | Nakamura et al. | 400/120 |
| 5,109,236 | 4/1992 | Watanabe et al. | 346/76 PH |

FOREIGN PATENT DOCUMENTS

| | | | |
|---|---|---|---|
| 0255462 | 12/1985 | Japan . | |
| 0255875 | 11/1986 | Japan | 400/120 |
| 0282947 | 12/1987 | Japan | 400/120 |
| 0013088 | 1/1988 | Japan . | |
| 0173655 | 7/1988 | Japan | 400/120 |
| 0286353 | 11/1990 | Japan . | |

*Primary Examiner*—Benjamin R. Fuller
*Assistant Examiner*—N. Le
*Attorney, Agent, or Firm*—Milton S. Sales

[57] ABSTRACT

In a thermal imaging printer system, a method and apparatus of marking the specularly reflective receiver media with indicia differing in specularity from the surface specularity of the media. In either transparent or opaque receiver media having a specularly reflective or glossy surface, alphanumeric characters are imprinted by a linear or dot matrix thermal printhead without transferring ink to the media surface. The application of thermal energy to the surface by the energized printhead elements is effective to melt the surface layer and change its specularity sufficient to render the printed indicia visible without affecting images otherwise printed on the receiver media. The marking method may be employed in relation to receiver media printed by photographic, thermal, xerographic, laser or other printing techniques as long as the specularity of the media surface may be changed by the application of localized thermal energy.

12 Claims, 1 Drawing Sheet

METHOD AND APPARATUS FOR MARKING A RECEIVER MEDIA WITH SPECULARLY DIFFERENTIATED INDICIA

BACKGROUND OF THE INVENTION

1. Field of the Invention

The present invention relates to a method and apparatus for creating unobtrusive indicia on image bearing media and particularly to a system employing a resistive element thermal printhead to thermally change the specularity of a marking area on the media to create indicia observable to the viewer.

2. Description of the Prior Art

The printing of high quality black and white and multiple color images on relatively glossy print media together with identification indicia, such as alphanumeric characters or spacing marks to identify the printed image, its date of printing and other information is well known in the prior art. For example, in photography, it is known to image latent frame numbers and marks on unexposed film, as taught, for example, in U.S. Pat. No. 4,553,833, which became visible after processing. In photographic printing, it is known to expose spacing marks along the sides of images printed on continuous rolls of photographic print media, to mark the reverse surfaces of photographic prints with the date of printing. It is also known to expose areas of X-ray film with latent-alphanumeric identification characters and other information applied by thermal elements energized by microcomputer stored image data as taught, for example, in U.S. Pat. No. 4,983,991, where the latent image characters become visible after processing the film. In thermal printing systems which effect a printing operation through heat transfer of dyes to a dye receiver media, it is known to print images or indicia and markings by dye transfer to the receiver media as taught, for example, by commonly assigned U.S. Pat. No. 4,710,781, and U.S. Pat. Nos. 4,995,741 and 4,516,137. It is also known from the '137 patent to employ heat sensitive media that changes color on application of heat and pressure from the thermal elements of a printhead.

In all of these contexts, particularly in relation to certain thermal printers, the printer head is connected to a variety of image generating sources. In one case, the image sources may be a series of imaging work stations that allow for generation of digital color images. These stations may be networked together so as to allow for transmission of the images from the work stations to the digital thermal printer or print engine. These images are received by the print engine and printed in accordance with a prioritizing scheme on an elongated web of thermally activated dye transfer receiver media. As a result of the prioritizing scheme, sets of interrelated images may be distributed out of sequence on the printed web media over a period of time. Alternatively, if the receiver media is in sheet form, the individual printed sheets may accumulate out of order in one or more bin.

In either case, the operator may be required to collate the related images and distribute them to various areas or customers. It is thus desirable that the printed images be individually identifiable for such distribution. It is advantageous to the operator to have the prints labeled with indicia identifying the source, content and/or distribution, as well as the date of printing. It is also advantageous for this information to be visually apparent to the trained operator but unobtrusive in other respects.

In a typical printed image identifying operation, the backsides of prints are marked using an impact printer and dye bearing web. In photographic printing, the print sequence of a set of customer negatives is memorized, and a separate stamping unit is employed downstream from the printing station to transfer dye from the dye bearing web to the appropriate location on the reverse side of the image bearing print using selectively controllable impact hammers. This method is disadvantageous when used on transparent sheets that are employed in image projection. Moreover, the printing operation may fail in the event that the dye bearing web for some reason fails.

In respect to the above-mentioned thermal printing systems, dye transfer is effected from a dye bearing donor web interposed between the thermal printhead elements and the receiver media in response to the applied thermal energy. Alternatively, thermally responsive print media is designed to change color upon application of minute amounts of thermal energy. In the former case, the separate dye transfer web suffers the drawbacks of the impact printer web, and in the latter case, the thermally responsive print media may be incompatible with the image bearing media.

In thermal dye transfer printing, the receiver media typically possesses a highly speculative or glossy finish or coating on the print surface and a dull finish or coating on the reverse surfaces of the media effected by a thin gelatin coating employed in part to decrease the effects of static electricity on the ability of the stacked sheet media to be separated and transported through the printing station. Transparency media and photographic print media are likewise usually inherently glossy on the image surface for practical or aesthetic reasons. Typical thermal photographic print media are disclosed in U.S. Pat. Nos. 4,778,782 and 4,983,991 incorporated herein by reference and are available from Eastman Kodak Company.

It is desirable therefore to provide a printing system for printing unobtrusive indicia on preexisting media that is simple and relatively failsafe.

SUMMARY OF THE INVENTION

It is accordingly an object of the present invention to provide a simple, reliable and economical printing system for printing unobtrusive information conveying indicia on a marking area of an image bearing media of given specularity.

In accordance with the present invention, it has been discovered that such marking may be accomplished by selectively altering the given specularity so as to create alphanumeric characters or other markings that are observable by the contrast between the altered specularity and the given specularity by viewing the same with light reflected from opaque media or transmitted through transparent or semi-transparent media. The method and apparatus of the present invention thus comprises employing a thermal printhead having selectively actuable resistive thermal elements to apply heat patterns to a marking area of given specularity to effect a change in that specularity, typically from dull to highly glossy, visible to the viewer.

The method and apparatus for creating visible markings on a marking area of an object having a surface of given specularity so as to provide descriptive information information thereon preferably comprises the steps of and means for applying a thermal printhead to the marking area on the surface, and modulating the heat and pressure applied by the thermal printhead so as to visibly impart information conveying marks in the marking area by visibly changing the specularity of the surface of the object in the marking area.

In accordance with the present invention, advantages taken of the preexisting surface coatings of photosensitive and thermal print media to effect marking thereon through the use of a dye transfer web.

BRIEF DESCRIPTION OF THE DRAWINGS

These and other objects, advantages and features of the present invention will become readily apparent to those skilled in the art from the following description of the preferred embodiments of which.

Figure 1:
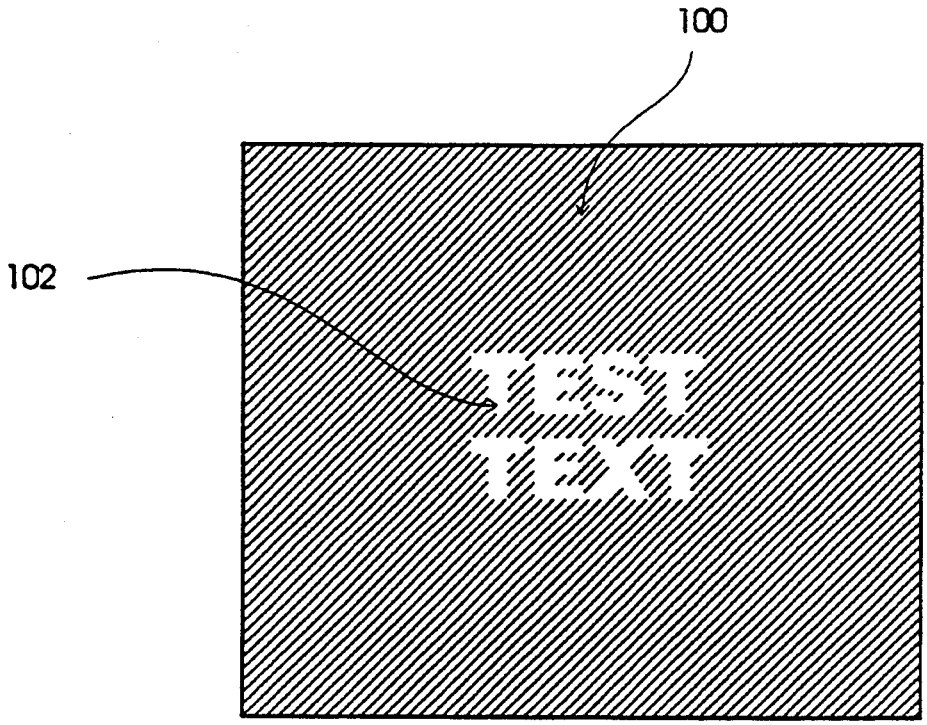
FIG. 1 is an illustration of indicia printed on a specularly reflective or transmissive image bearing media in accordance with the present invention.

The drawings are not necessarily to scale.

DETAILED DESCRIPTION OF THE PREFERRED EMBODIMENTS

In accordance with the present invention, a thermal printer of the type disclosed in U.S. Pat. No. 4,710,783 patent (incorporated herein by reference in its entirety) may include a linear array of thermal printhead elements 50 of the type depicted in FIG. 3 thereof disposed to contact the reverse side of the thermal print media or receiver sheet 12 at a printing station in the path of travel of the sheet. However, in the practice of the present invention, the dye-donor web 14 is not employed. After a print is made on the image bearing surface, a command is received by the microcomputer 17 (FIGS. 5 and 6 of the '783 patent) and the sheet 12 is reversed and again advanced to the printing station, it is contemplated that the thermal print elements will be actuated as the sheet is moved to generate alphanumeric characters from heat generated pixel-sized melting of the receiver sheet coating of this application under the control of the microcomputer 17 and interface 68 as described in the '783 patent. For example, the thermal printhead may comprise a linear array of nine elements selectively actuated in a well known fashion under the control of a digital image processor to create alphanumeric characters as depicted in FIG. 1.

More specifically, in the context of the thermal print apparatus of the '783 patent (without the web 14 between the receiver sheet 12 and print head 18) the method of the present invention may be practiced by disposing the linear array of thermal elements of the printhead 18 in relation to the non-image bearing surface of a photographic print, a transparency or a thermal image receiver sheet 12 having a relatively dull, non-specular surface. The platen 16 bears against the image bearing surface to press the array of resistive elements 50 on the printhead 18 into contact with the nonprint surface as the sheet 12 is advanced. The image information to be printed (supplied by a data input terminal) is stored in a buffer in relation to the printhead as disclosed, for example, in the above-incorporated '783 patent. As the sheet is moved past the thermal printhead, the individual energized thermal elements 50 generate pixel-sized heat based on the stored information in the non-image bearing surface of the sheet 12.

The application of thermal energy from the thermal elements 50 of the '783 patent effects a melting of individual dots or pixels which harden shortly after the thermal elements are deenergized and the media is advanced to the next pixel line. The melting and hardening changes the specularity of the dot or pixel with respect to the background specularity. As a result, an unobtrusive image may be created that is readable by reflected light in opaque media or both transmitted and reflective light in transparent media.

Referring now to FIG. 1 of this application, it illustrates a test sheet 100 having a low gloss, low specularity, matte surface with high gloss characters 102 formed therein by application of heat and rendered visible by reflection of light, especially when viewed at an angle to the sheet. The change in roughness of the melted surface layer can also be perceived by touch, aiding in initially locating the printed area.

Figure 2:
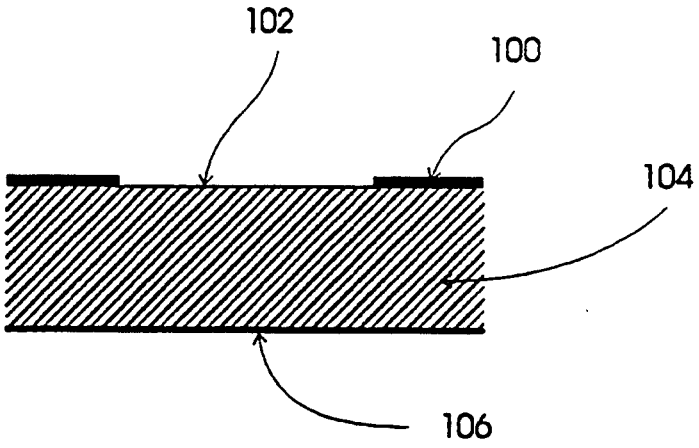
FIG. 2 is a side view of the indicia printed media of FIG. 1.

FIG. 2 is a side view of an image bearing print media as shown in FIG. 1. The paper core 104 has an image bearing area 106 on a side opposite to the side depicted in FIG. 1. Thus, in practice, the high gloss markings 102 may be effected by thermal printing elements on the low gloss backing surface 100 in conjunction with or simultaneously with the printing of an image in the image bearing area 106 or subsequently in a further printing operation. Although the image bearing area 106 is illustrated as being on the opposite surface of the core 104 from the printed indicia, it will be understood that both can be applied to the same side of the media. The media may also take other forms including transparent media.

A series of experiments were completed to test a variety of media. In one test, reflective thermal media comprising a thermal-dye receiving sheet having a matte finish, gelatin-based coating was exposed to thermal printhead energy in a manner described above in respect to the '783 patent. The thermal modulation of the individual elements of the printhead melted the gelatin and created dots or pixel indices with a high gloss or shininess. There appeared to be no build-up of material on the thermal elements and the resulting printed alphanumeric characters were visible at an angle to the sheet surface and were read clearly by a variety of test subjects. There was no change in color rendering the characters visible.

A second experiment was completed where the same thermal printhead was used to expose typical transparent thermal dye receiving media to thermal energy. This media was a polyethylene terephthalate (PET) base with a gelatin based back coating finished so as to create a very smooth highly specular surface so that transmitted light is not scattered. This media was exposed to a thermal printhead and indicia were printed on the glossy surface that were clearly readable to a variety of test subjects. The application of thermal energy in the dots or pixel areas mechanically disrupted the gelatin base back coating causing its surface to become rough to the point that the thermally printed indicia was clearly readable. Again, no appreciable build-up occurred on the thermal printhead elements, and no change in color was observed.

These experiments establish that a thermal printhead can provide marking data or indicia on a variety of image bearing media. The use of gloss variations creates indices that have the additional property of being unobtrusive to the typical observer who would not be looking for the marking. Different degrees of marking intensity can be achieved by changing the energy delivery of the thermal head and the chemistry of the marking area. In one improvement, the dull area on the back of an image bearing media is made more diffuse by the application of heat meltable particles that flow into a glossy surface. For example, particles consisting of polycarbonate beads that melt into a low-melt polymer such as polyethylene or polypropylene, might be employed in a surface layer intended to be employed as a marking area on a media. In the context of transparencies, coatings that fracture or change phase from glossy to matte surfaces in the presence of heat could also be employed to change the specularity of the surface in the manner described above.

While there has been shown what is considered to be the preferred embodiments of the invention, it will be manifest that many changes and modifications may be made therein without departing from the essential spirit of the invention. It is intended, therefore, in the annexed claims to cover all such changes and modifications as may fall within the true scope of the invention.

What is claimed is:

1. A method of creating visible markings on a marking area of an object having a surface of given matte versus gloss characteristic so as to provide descriptive information thereon comprising the steps of:

applying a thermal printhead to the marking area on the surface; and modulating the thermal printhead to imagewise apply thermal energy to said surface to change the matte versus gloss characteristic, and thereby a specularity, of said surface so as to visibly impart information conveying marks in the marking area by visibly changing the specularity of the surface of the object in the marking area.

2. The method of claim 1 wherein the marking area has a high specularity and the step of modulating the thermal printhead thereby includes the step of marking the surface by creating marks of low specularity in the marking area.

3. The method of claim 1 wherein the marking area has a low specularity and the step of modulating the thermal printhead thereby includes the step of marking the surface by creating marks of high specularity in the marking area.

4. The method of claim 1 wherein the object is an image bearing sheet media having an image receiving surface and a marking area surface and wherein the step of modulating the thermal printhead includes marking the sheet media in the marking area on the surface.

5. The method of claim 4 wherein the marking area has a high specularity and the step of modulating the thermal printhead thereby includes the step of marking the surface by creating marks of low specularity in the marking area.

6. The method of claim 4 wherein the marking area has a low specularity and the step of modulating the thermal printhead thereby includes the step of marking the surface by creating marks of high specularity in the marking area.

7. An apparatus for creating visible information conveying marks on a marking area of an object having a surface with a given matte versus gloss characteristic comprising:

means for defining a marking area disposed on the surface;

means for applying heat sufficient to change the matte versus gloss characteristic of the surface in the marking area; and control means for modulating the heat applied by said heat applying means so that information is recorded in the marking area in the form of visible change in the matte versus gloss characteristic, and thereby a specularity, of the surface without imparting a color change thereto.

8. The apparatus of claim 7 wherein the marking area has a high specularity and the control means for modulating the heat creates marks of low specularity in the marking area.

9. The apparatus of claim 7 wherein the marking area has a low specularity and the control means for modulating the heat creates marks of high specularity in the marking area.

10. The apparatus of claim 7 wherein the object is an image bearing sheet media having an image receiving surface and a marking area surface and wherein the control means further includes means for marking the sheet media in the marking area on the surface.

11. The apparatus of claim 10 wherein the marking area has a high specularity and the control means for modulating the heat creates marks of low specularity in the marking area.

12. The apparatus of claim 10 wherein the marking area has a low specularity and the control means for modulating the heat creates marks of high specularity in the marking area.

* * * * *